US008684398B1

(12) United States Patent
Nyitray

(10) Patent No.: US 8,684,398 B1
(45) Date of Patent: Apr. 1, 2014

(54) ADJUSTABLE WHEELCHAIR SEAT

(71) Applicant: Michael Nyitray, Parkland, FL (US)

(72) Inventor: Michael Nyitray, Parkland, FL (US)

( * ) Notice: Subject to any disclaimer, the term of this patent is extended or adjusted under 35 U.S.C. 154(b) by 0 days.

(21) Appl. No.: 13/920,528

(22) Filed: Jun. 18, 2013

(51) Int. Cl.
*A61G 5/10* (2006.01)

(52) U.S. Cl.
USPC ..... 280/657; 280/250.1; 280/47.38

(58) Field of Classification Search
USPC ..... 280/642, 647, 650, 657, 47.38, 47.39, 280/47.41, 250.1
See application file for complete search history.

(56) References Cited

U.S. PATENT DOCUMENTS

| | | | | |
|---|---|---|---|---|
| 4,403,673 | A | 9/1983 | Ball | |
| 4,457,528 | A | 7/1984 | Ichikawa et al. | |
| 5,439,240 | A | 8/1995 | Tichenor et al. | |
| 5,884,929 | A * | 3/1999 | Kincaid | 280/304.1 |
| 6,004,233 | A * | 12/1999 | Raubuck et al. | 473/505 |
| 6,024,369 | A | 2/2000 | Goldstein et al. | |
| 6,510,567 | B1 | 1/2003 | Robbins | |
| 6,578,854 | B2 * | 6/2003 | Wucherpfennig et al. | 180/330 |
| 7,083,019 | B2 | 8/2006 | Chiou et al. | |
| 7,104,346 | B2 | 9/2006 | Schaffner | |
| 7,798,546 | B2 | 9/2010 | Kniss | |
| 7,997,597 | B2 | 8/2011 | Mehl | |
| 2008/0111388 | A1 | 5/2008 | Kniss | |
| 2011/0276233 | A1 * | 11/2011 | Lofstrand | 701/49 |
| 2012/0261955 | A1 * | 10/2012 | Iida et al. | 297/188.04 |
| 2013/0020850 | A1 | 1/2013 | Lucas | |

OTHER PUBLICATIONS

"Lawn Bowling Wheelchair," May 24, 2012, p. 1. http://btckstorage.blob.core.windows.net/site1193/Special%20Needs/wheelchair.jpg.
Turner, "Skycare Chair," Yanko Design, Jan. 23, 2012, p. 2-4. http://www.yankodesign.com/2012/01/23/wheelchair-for-air-travel/.

* cited by examiner

*Primary Examiner* — John Walters
(74) *Attorney, Agent, or Firm* — Seager, Tufte & Wickhem LLC

(57) ABSTRACT

A motorized vehicle assembly having a frame, a seat supported by the frame, and one or more wheels in communication with the frame, where the frame may have a plane extending therethrough and the seat may have a plane extending therethrough. The seat may be adjustable with respect to frame. The seat may be adjusted laterally in a first direction and/or a second direction, where the seat faces a third direction that is substantially perpendicular to the first direction and the second direction. The seat may be rotated or tilted toward the first direction, the second direction, the third direction, or a fourth direction, where the fourth direction may be substantially opposite the third direction. In some cases, the seat may be tilted in the same direction in which the seat has been laterally adjusted.

20 Claims, 11 Drawing Sheets

ADJUSTABLE WHEELCHAIR SEAT

TECHNICAL FIELD

The disclosure is directed to vehicles, such as wheelchairs. More particularly, the disclosure is directed to wheelchairs configured to be used in one or more activities in which a user is participating.

BACKGROUND

Conventional vehicles (e.g., mobility vehicles), such as wheelchairs, may be manually operated and/or may be powered by a motor. Illustratively, manual and powered or motorized wheelchairs typically include a frame, a seat supported by the frame and a plurality of wheels in communication with the frame. Typically, a powered or motorized wheelchair may include a motor supported by a structure of the frame, where the motor may be in communication with one or more wheels connected to the frame. Typical powered or motorized vehicles include a power source. For example, typical power sources may include a battery located within the frame.

SUMMARY

This disclosure is directed to several alternative or complementary designs of, materials of, and methods of using vehicles, such as wheelchairs. Although it is noted that various wheelchairs exist, there exists need for improvement on those devices.

Accordingly, one illustrative embodiment of the disclosure may include a vehicle assembly having a frame, a seat supported by the frame, and a plurality of wheels supporting the frame. The seat and frame of the wheelchair may each have a plane extending therethrough and equidistance from the first side of the wheelchair and the second side of the wheelchair. The seat of the wheelchair, in some cases, may be adjustable in a first direction and a second direction to position the plane of the seat in a position offset from and parallel to the plane of the frame. Additionally, the seat of the wheelchair, in some cases, may be adjustable to position the plane of the seat in a non-parallel orientation with respect to the plane of the frame.

In some instances, the disclosure may include a wheelchair assembly including a seat, one or more wheels, and a support, where the seat may have a base and a back portion facing a first direction. The support may support the seat and the one or more wheels with respect to the seat. The seat of the wheelchair assembly may be laterally adjustable in a second direction and a third direction, where the second and third direction may be substantially perpendicular to the first direction. Additionally, the seat may be rotatable toward the first direction and the second direction with respect to the support.

In operation, the wheelchair may be used in any of one or more methods of adjustment. For example, a seat of the wheelchair may be laterally slid in one of a first direction and a second direction. Further, the seat of the wheelchair may be rotated toward the one of the first direction and the second direction. The first direction and/or the second direction in which the seat is laterally adjusted and toward which the seat is rotated may be substantially perpendicular to a third direction in which a back portion of the seat is facing. Additionally, a user may roll a bowling ball or participate in a sporting activity while seated in the laterally adjusted and rotated seat to roll the bowling ball or otherwise participate from an off-centered and rotated or tilted position. Additionally, or alternatively, the wheelchair may be used in other activities (including sporting activities). Such activities may include, but are not limited to fencing, horse shoes, lawn bowling, track and field events, bocce ball, tennis, basketball, softball, gardening, etc.

The above summary of some example aspects is not intended to describe each disclosed embodiment or every implementation of the claimed disclosure.

BRIEF DESCRIPTION OF THE DRAWINGS

The disclosure may be more completely understood in consideration of the following detailed description of various embodiments in connection with the accompanying drawings, in which.

Figure 1:
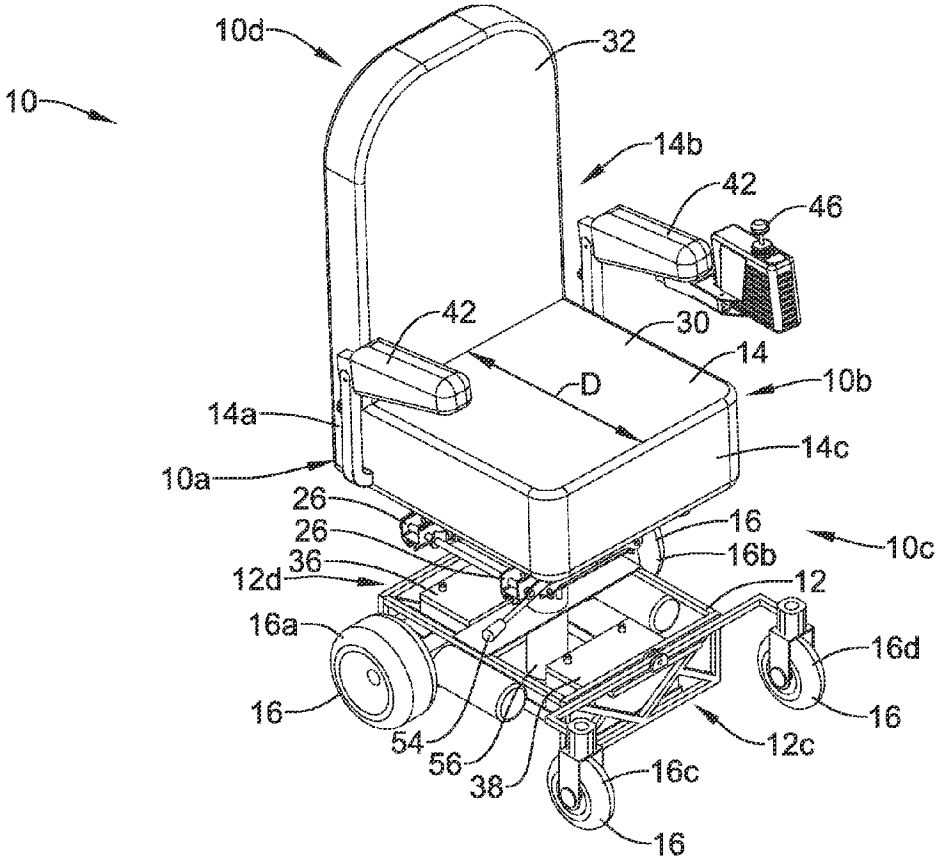
FIG. 1 is a schematic perspective view from above of an illustrative powered wheelchair structure.

While the disclosure is amenable to various modifications and alternative forms, specifics thereof have been shown by way of example in the drawings and will be described in detail. It should be understood, however, that the intention is not to limit aspects of the claimed disclosure to the particular embodiments described. On the contrary, the intention is to cover all modifications, equivalents, and alternatives falling within the spirit and scope of the claimed disclosure.

DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the claimed disclosure. The illustrative embodiments depicted are intended only as exemplary. Selected features of any illustrative embodiment may be incorporated into an additional embodiment unless clearly stated to the contrary. Further, any numbers used to describe like features (e.g., a first wheel and a second wheel) are used for clarity of descriptiveness purposes and are not meant to limit the interpretation or scope of such features.

Generally, as described herein, a mobility vehicle assembly may be a wheelchair 10, as shown in FIGS. 1-9, or any other vehicle. The wheelchair 10 may be manually operated or may be a powered wheelchair 10. In some instances, the wheelchair 10 may include a frame or support 12, one or more seats 14, and/or one or more similar or dissimilar wheels 16 (e.g., a first wheel 16*a*, a second wheel 16*b*, a third wheel 16*c*, a fourth wheel 16*d*, etc.), where at least one wheel 16 may be configured to be out of the way of a user when the user swings its arm. For example, as shown in the Figures, on a performance side of the wheelchair 10 (e.g., a side of the wheelchair 10 without an armrest 42, a joystick controller 46, other potentially restrictive feature, or with a potentially restrictive feature that can be adjusted and/or moved from a user's path), the first wheel 16*a* and the third wheel 16*c* may be positioned such that they do not fully restrict a user's arm motion (e.g., an arm has a full or srange of motion) when the user is swinging its arm (e.g., while rolling a bowling ball, tossing a softball, swinging a golf club, swinging a tennis racquet, etc.).

Figure 2:
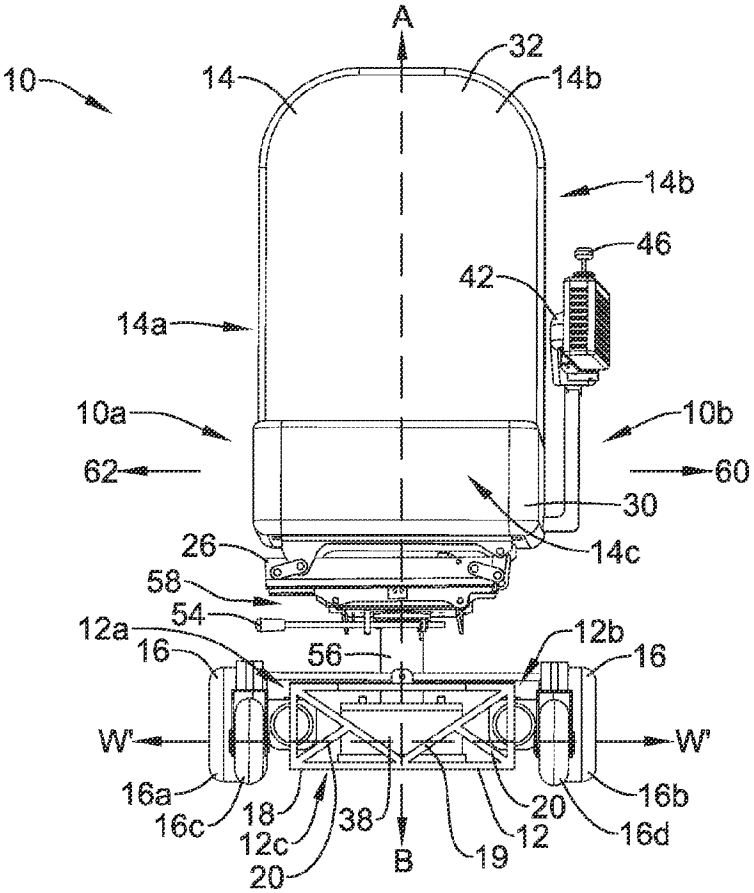
FIG. 2 is a schematic view from a front of an illustrative powered wheelchair structure.

In some cases, the wheelchair 10 may be motorized. A motorized wheelchair 10 may include a power generator (e.g., a motor 36) and energy to feed the power generator (e.g., a battery 38, such as a full-size marine battery or other battery 38, as desired), as shown throughout FIGS. 1-9. The power generator may be any type of motor, such as an electric motor, a gas motor, or other motor typically used on mobility vehicles (e.g., motorized wheelchairs 10). The battery 38 may be any type of battery configured to store electricity and may include one or more batteries, as desired. The motor 36 and the battery 38 may be in at least electrical communication with one another and may be in a single housing, separate housings, separable housings, or one or more of the motor 36 and the battery 38 may not include a housing, as desired. Additionally, or alternatively, the battery 38 may be utilized to power a motor 70 utilized to adjust the seat 14 with respect to the frame or support 12. As shown in FIGS. 1-9, the motor 36 and the battery 38 may be supported by the frame or support 12 of the wheelchair 10. In some instances, one or more of the motor 36 and the battery 38 may be supported by or at or near a base of the frame or support 12, as shown in FIG. 2.

In addition to, or in alternative to, a battery 38 and/or a motor 36 positioned on the second side 12*b* of the frame or support 12, the frame or support 12 may support a weight. In some instances, the weight may act as a ballast and may be positioned so as to facilitate maintaining a center of gravity of a user and wheelchair 10 between the first side 10*a*, the second side 10*b*, the third side 10*c*, and the fourth side 10*d* of the wheelchair 10 when a user is participating in an activity in which the user may need to lean toward a side of the wheelchair 10. Illustratively, the weight may include one or more of the motor 36, the battery 38, and any other feature having a mass and/or configured as a ballast to facilitate maintaining a center of gravity of a user and the wheelchair 10.

The wheelchair 10 may have any size and/or dimension. For example, the distance from the seat 14 to a floor or ground may be at least one inch, at least two inches, at least five inches, at least ten inches, at least eighteen inches, at least twenty inches, etc. Similarly, other features of the wheelchair 10 may take on any typical or atypical sizes or dimensions of wheelchairs 10, as desired.

The frame or support 12 may be configured to be in communication with the one or more seats 14 (e.g., the frame or support 12 may be configured to support the seat(s) 14) and/or in communication with the one or more wheels 16. In one example, the frame or support 12 may support the seat 14 and support the one or more wheels 16 with respect to the seat 14

The seat(s) 14 may be a suitable type of seat. For example, the seat 14 may be one or more layers of fabric and/or other material(s) extending between, under, on, and/or over a seat frame, the seat 14 may have a cushioned base portion and fabric back portion, the seat 14 may be an automobile seat, and/or the seat 14 may have any other configuration, as desired. In some instances, the seat 14 may have a plurality of portions. For example, the seat 14 may have a first portion 30 (e.g., the base portion) and a second portion 32 (e.g., the back portion). In some instances, the first portion 30 of the seat 14 may have a depth D, as shown in FIG. 1, where the depth D may have a first distance. The second portion 32 of the seat 14 may have a height H, as shown in FIG. 1, where the height H may have a second distance. Illustratively, the second distance may be equal to the first distance, the second distance may be less than first distance, or the second distance may be greater than the first distance (e.g., such as in an automobile seat), as shown in FIGS. 1-9.

The first portion 30 and second portion 32 of the seat 14 may have any number of sub-portions spanning from a first side 10*a* of the wheelchair 10 to a second side 10*b* of the wheelchair 10. As shown in the Figures, the first portion 30 and the second portion 32 of the seat 14 each may comprise a single sub-portion (e.g., cushions or other seat dividers), but this is not required and one or more of the first portion 30 and the second portion 32 may have multiple seat sub-portions. For example, the seat 14 may have a single sub-portion configured for a single person, a single sub-portion configured for multiple people, multiple sub-portions configured for a single person, multiple sub-portions configured for multiple people, and/or any other set of sub-portions configured for any number of people. In one example, the first portion 30 and the second portion 32 of the seat 14 may each have one sub-portion toward the first side 10*a* of the wheelchair 10 and a separate sub-portion toward the second side 10*b* of the wheelchair 10 (not shown).

The wheels 16 may have a suitable shape and/or dimension as desired. In some instances, smaller diameter wheels 16 as compared to larger diameter wheels 16 may allow the wheelchair 10 to have a center of gravity nearer a floor or ground surface. Further, the wheels 16 may have any thickness, width, and/or density, as desired. For example, high pressure wheels 16 or solid rubber wheels 16 may be used and may reduce centrifugal bouncing when a user of the wheelchair 10 is participating in activities. Alternatively, or in addition, the wheelchair 10 may have other advancing mechanisms including, but not limited to, tracks, rotating bands, skis, and other similar and/or dissimilar advancing mechanisms.

As shown in FIGS. 1-9, the wheelchair 10 may include one or more armrests 42 (e.g., two armrests 42 are shown in FIG. 1 and one armrest 42 is shown in FIGS. 2-9). The armrests 42 may be configured for any purpose. For example, the armrests 42 may be configured for comfort while a user uses the wheelchair 10, to support a user while the user may be positioned within the adjusted wheelchair 10, and/or configured for other purposes. In some instances, one or more of the armrests 42 may be moveable or adjustable to clear or substantially clear a side of the wheelchair 10 (e.g., a performance side of the wheelchair 10) to allow a user to participate in an activity by providing a space to the side of the wheelchair 10 for a full or substantially full range of motion for a user's arm, which may facilitate the user's participation in an activity.

As shown in the figures, the armrest 42 may support a joystick controller 46 or other controller. The joystick controller 46 may be configured to be interacted with to navigate the wheelchair 10 and/or adjust the positioning of the seat 14 from side-to-side and/or adjust a rotation of the seat 14. In some cases, the armrest 42 may support a separate controller configured to adjust the position of the seat. Alternatively, or in addition, the joystick controller 46 or other controller (e.g., a seat adjusting controller, etc.) may be connected to any other feature of the wheelchair 10, including, but not limited to, the frame or support 12 and the seat 14. Other controllers and controller configurations are contemplated.

Figure 3:
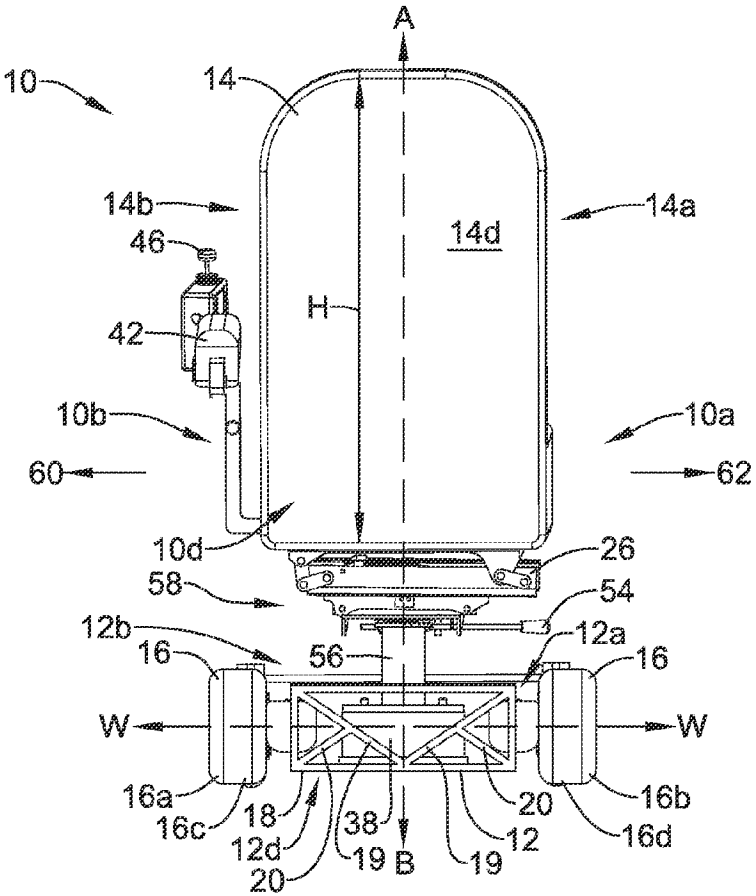
FIG. 3 is a schematic view from a rear of an illustrative powered wheelchair structure.
Figure 4:
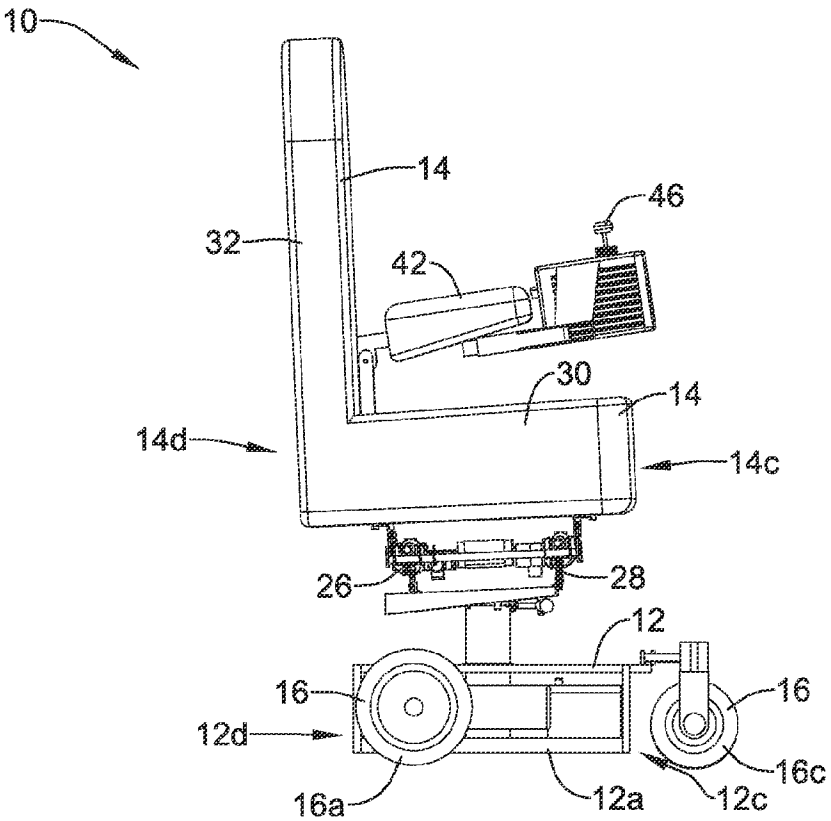
FIG. 4 is a schematic view from a side of an illustrate powered wheelchair structure.
Figure 5:
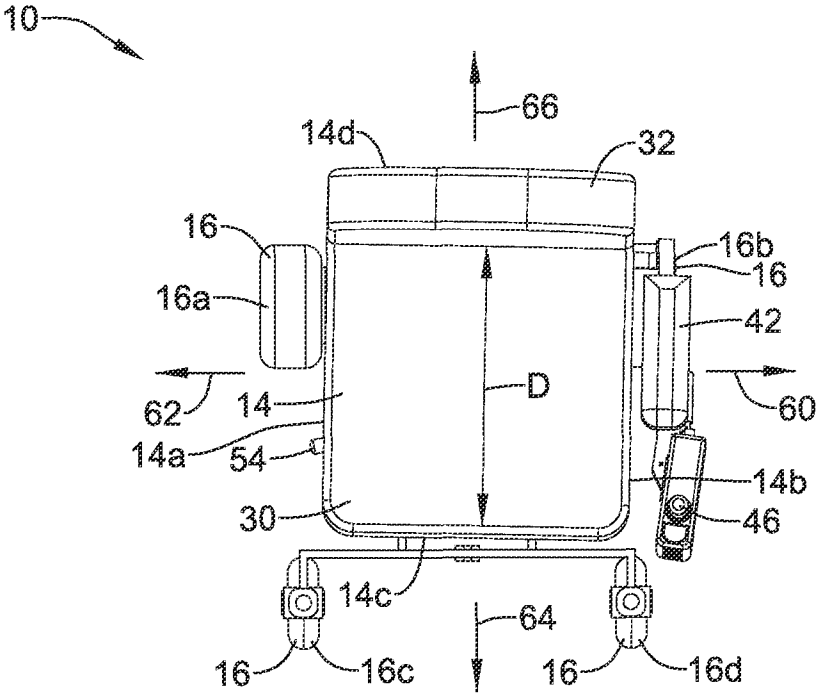
FIG. 5 is a schematic view from a top of an illustrative powered wheelchair structure.

In some instances, a pair or more of the one or more wheels 16 (e.g., the first wheel 16*a* and the second wheel 16*b* or the third wheel 16*c* and the fourth wheel 16*d*) may be configured to rotate about a wheel axis W-W (FIG. 3) or W'-W' (FIG. 2) of the wheelchair 10. For example, the first wheel 16*a* may be configured to rotate relative to the frame or support 12 and about the wheel axis W-W, and the second wheel 16*b* may be configured to rotate relative to the frame or support 12 and about the wheel axis W-W, as shown in FIG. 3, where one or more wheel axles or wheel extensions may extend through axis W-W. In some cases, the pair of wheels 16 may be configured to rotate about the wheel axis W-W or W'-W' may be positioned or located toward a rear portion of the wheelchair 10 (as shown in FIG. 3) or a front portion of the wheelchair 10 (as shown in FIG. 2). Alternative, or in addition, one or more of the wheels 16 may be caster wheels or other wheel types that are configured to rotate and/or swivel about a wheel axis W-W, W'-W', or other axis.

The frame or support 12 may have a plane B-B extending therethrough, as shown in FIGS. 2 and 3 (note, plane B-B (e.g., a second plane) overlaps with plane A-A (e.g., a first plane) in FIGS. 2 and 3). In some instances, the plane B-B may be positioned between an edge of a first side 12*a* of the frame or support 12 and an edge of a second side 12*b* of the frame or support 12 and may extend through an edge of a third side 12*c* of the frame or support 12 and an edge of a fourth side 12*d* of the frame or support 12. In one example, the plane B-B (e.g., a central plane) may be positioned equidistance from the first side 16*a* of the frame or support 12 and from the second side 16*b* of the frame or support 12, but this may not always be the case.

Generally, the frame or support 12 may be separable from other features of the wheelchair 10 and may be configured to be used in a variety of wheelchair 10 orientations. For example, the frame or support 12 may be configured to be used in a wheelchair 10 that may have an orientation for a right-handed user needing to be able to lean toward the right to participate in one or more activities and/or in a wheelchair 10 that may have an orientation for a left-handed user needing to be able to lean toward the left to participate in activities. Such a configured frame or support 12, in some cases, may be symmetric about plane B-B of the frame or support 12 and/or symmetric from the rear 10*d* of the wheelchair 10 to the front 10*c* of the wheelchair 10 to facilitate being used in the manufacturing of wheelchairs 10 manufactured for left-handed users and wheelchairs 10 manufactured for right-handed users. Some example wheelchair frames may be found in U.S. patent application Ser. No. 13/650,566 filed on Oct. 12, 2012 and entitled "MULTIPURPOSE VEHICLE", which is hereby incorporated by reference in its entirety for all purposes.

As shown in FIGS. 1-9, the frame or support 12 may include a double K-frame. As best shown in FIGS. 2 and 3, the double K-frame frame or support 12 may have an outer frame 18. From an upper left corner of the outer frame 18 one sub-support 19 may extend to a lower mid-portion of the outer frame 18. From an upper right corner of the outer frame 18 one sub-support 19 may extend to the lower mid-portion of the outer frame 18 adjacent the other sub-support 19. From a lower left corner of the outer frame 18 a mid-support 20 may extend to a mid portion of one of the sub-supports 19 (e.g., the closest sub-support 19, the sub-support 19 that will provide the most support for the wheelchair 10, or other sub-support 19). From a lower right corner of the outer frame 18 a mid-support 20 may extend to a mid portion of one of the sub-supports 19 (e.g., the closest sub-support 19, the sub-support 19 that will provide the most support for the wheelchair 10, or other sub-support 19). The sub-supports 19 and the mid-supports 20 may be positioned in substantially the same positions at the third side 12*c* of the frame or support 12 and the fourth side 12*d* of the frame or support 12. Alternatively, or in addition, any side of, or portion in, the outer frame 18 may include one or more sub-supports 19 and/or one or more mid-supports 20 in any orientation, as desired. Although the outer frame 18, the sub-supports 19, and the mid-supports 20 are described and shown herein as being in particular orientations with respect to one another, it is contemplated the outer frame 18, the sub-supports 19, and/or the mid-supports 20 may have other spatial relationships that may be substantially similar to the described orientations and/or that are different than the described orientations. In some instances, the frame or support 12 may include one or more less or additional sub-supports 19 and/or mid-supports 20, and/or the outer frame 18, the sub-supports 19, and/or the mid-supports 20 may take on and/or form shapes other than those described and shown herein.

In some instances, the seat 14 may have a plane A-A extending therethrough, as shown in FIGS. 2 and 3 (as noted above, plane A-A overlaps with plane B-B in FIGS. 2 and 3). The plane A-A may be positioned between an edge of the first side 10*a* of the wheelchair 10 and an edge of the second side 10*b* of the wheelchair 10 and may extend through an edge of a third side 10*c* of the wheelchair 10 and an edge of a fourth side 10*d* of the wheelchair 10. In one example, the plane A-A (e.g., a central plane) may be positioned equidistance or substantially equidistance from the edge of the first side 10*a* of the wheelchair 10 and from the edge of the second side 10*b* of the wheelchair 10, but this may not always be the case. The edges of the sides (e.g., sides 10*a*-10*d*) of the wheelchair 10 may be defined by the outer perimeter of the wheelchair 10 at a particular height and may be formed by outer edges of the frame or support 12, the seat 14, or other features of the wheelchair 10. Alternatively, or in addition, the edges of the sides (e.g., sides 10*a*-10*d*) of the wheelchair 10 may be defined by a box formed around the wheelchair that has edges running tangential to the widest, tallest, and lowest points thereon.

Figure 6:
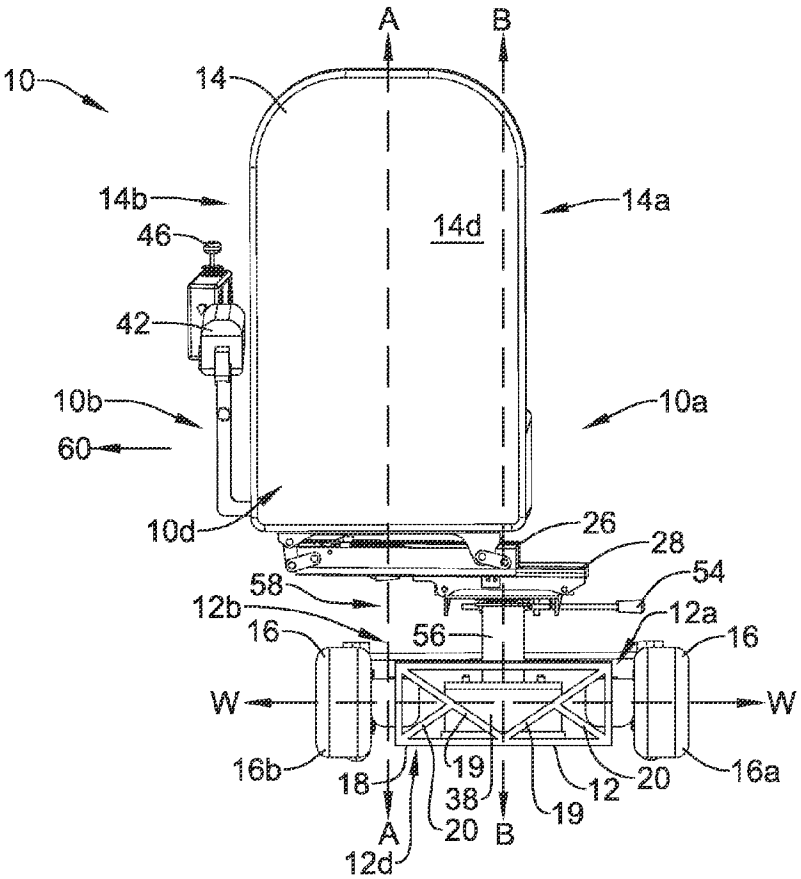
FIG. 6 is a schematic view from the rear of an illustrative powered wheelchair structure.
Figure 7:
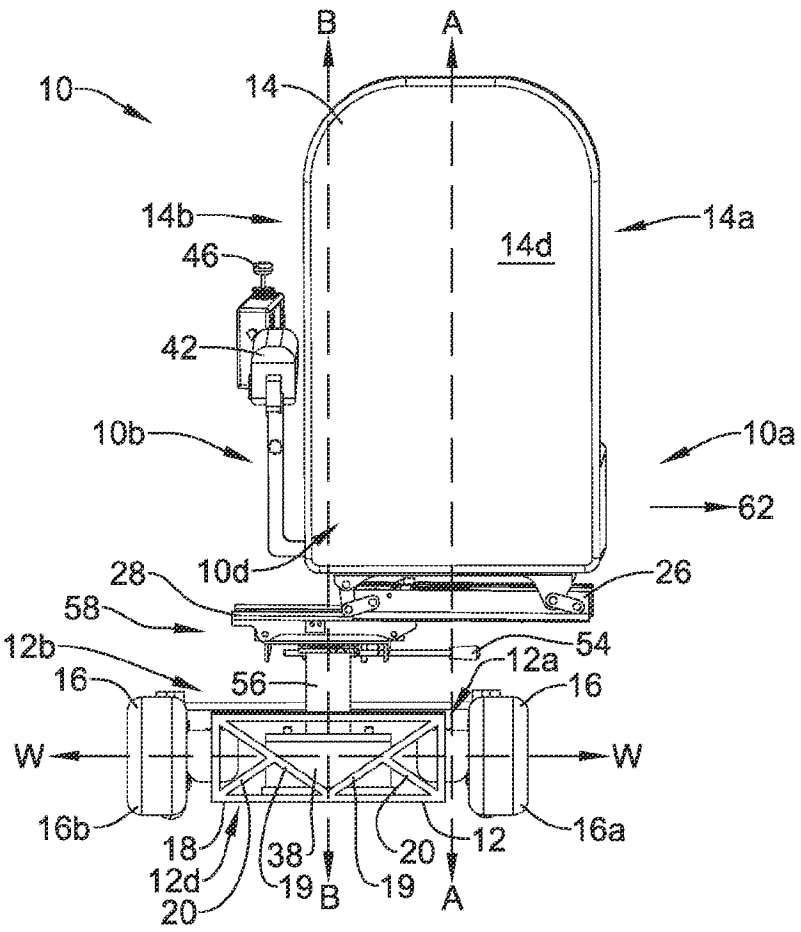
FIG. 7 is a schematic view from the rear of an illustrative powered wheelchair structure.

In some instances, the seat 14 may be adjustable. For example, the seat 14 may be adjustable (e.g. laterally adjustable) in at least a first direction 60 (as shown in FIG. 6) and a second direction 62 (as shown in FIG. 7), where the seat may be adjusted with respect to the frame or support 12. Illustratively, the first direction 60 and second direction 62 may be relative to a direction (e.g., the third direction 64) in which the seat 14 (e.g, the second portion 32 or back portion of the seat 14) is facing. In one example, the first direction 60 and the second direction 62 may be substantially perpendicular to the third direction 64 in which the second portion 32 of the seat 14 is facing, as shown in FIG. 3. As used herein, "substantially perpendicular" may mean within about one degree of being perpendicular, within about two degrees of being perpendicular, within about five degrees of being perpendicular, within ten degrees of being perpendicular, within twenty degrees of being perpendicular, or within forty-five degrees of being perpendicular.

Adjusting the seat 14 in the first direction 60 and/or the second direction 62 may position the plane A-A of the seat 14 in a position offset from and parallel to the plane B-B of the frame or support 12. Alternatively, or in addition, the seat 14 may be adjusted in the third direction 64 and/or a fourth direction 66, where the third direction 64 and the fourth direction 66 may be substantially perpendicular to the first direction 60 and the second direction 62. When adjusting the seat 14 in the third direction 64 and/or the fourth direction 66, the orientation of the plane A-A of the seat 14 with respect to the plane B-B of the frame or support 12 (e.g., the angle and/or distance between the plane A-A and the plane B-B) may not change. For example, if the plane A-A is in-line with the plane B-B, the plane A-A is offset from but parallel to the plane B-B, or if the plane A-A is non-parallel to the plane B-B, after adjusting the seat 14 in the third direction 64 and/or the fourth direction 66 the plane A-A may be in substantially the same orientation with respect to the plane B-B (e.g., the plane A-A remains in-line with the plane B-B, the plane A-A remains offset from but parallel to and the same distance from the plane B-B, or the plane A-A remains non-parallel to and the same angle from the plane B-B).

Figure 8:
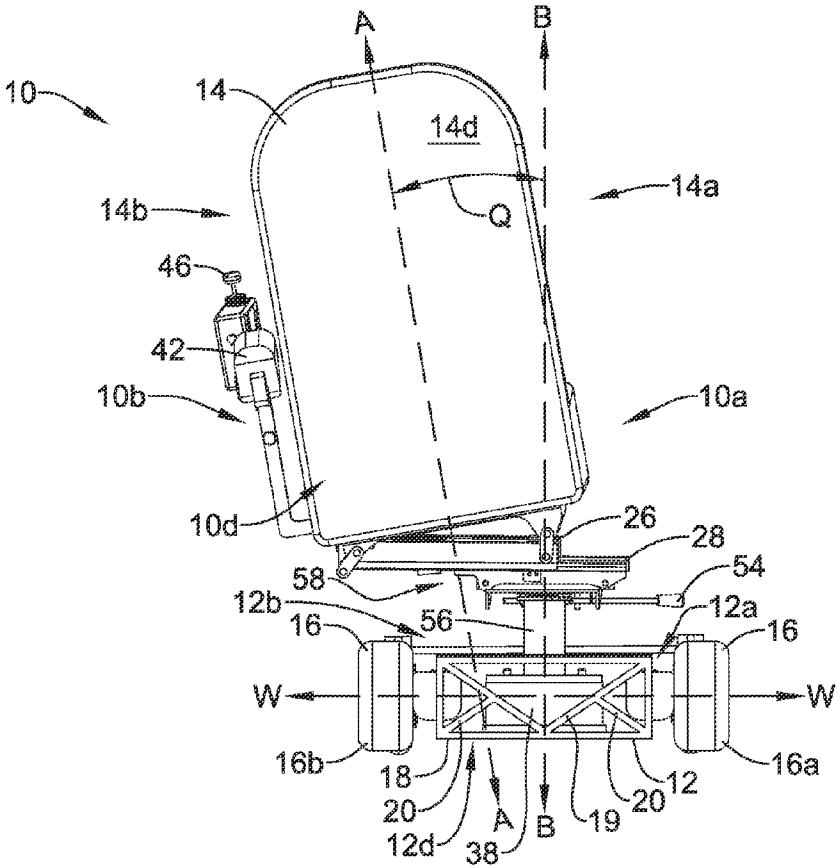
FIG. 8 is a schematic view from the rear of an illustrative powered wheelchair structure.
Figure 9:
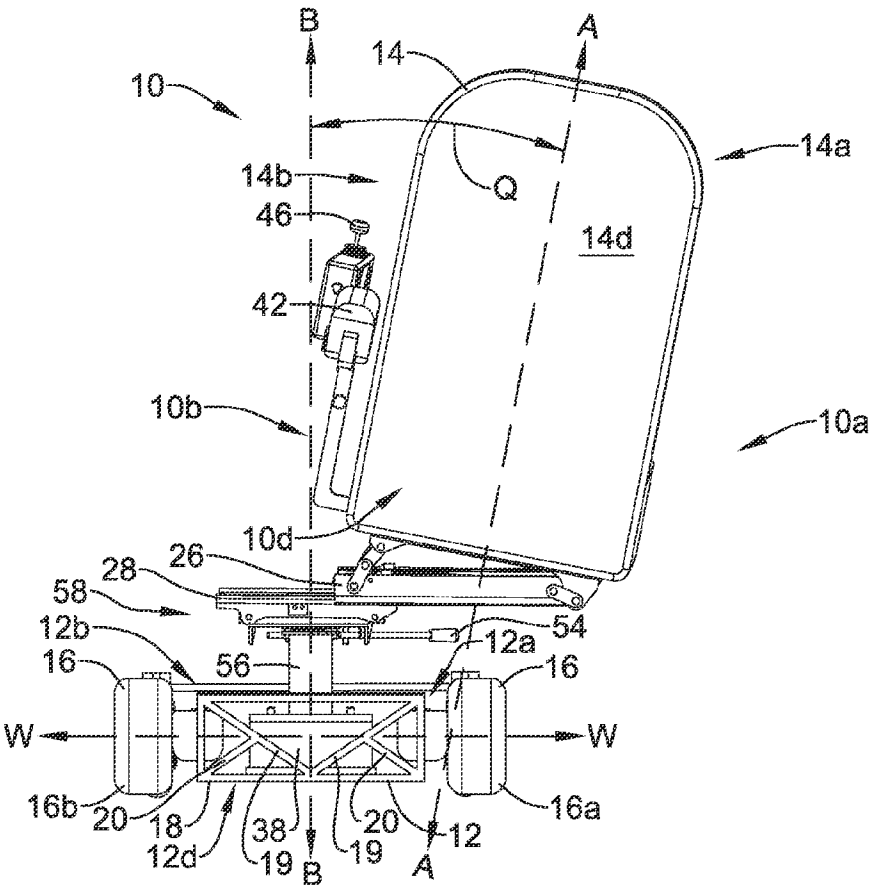
FIG. 9 is a schematic view from the rear of an illustrative powered wheelchair structure.

Additionally, or alternatively, the seat 14 may be adjustable such that the plane A-A of the seat 14 may be positioned in a non-parallel orientation with respect to the plane B-B of the frame or support 12. For example, the seat 14 or a portion thereof may be adjustable (e.g., rotated, tilted, lifted) toward the first direction 60 (e.g., a top of the seat 14 may be rotated toward the first direction 60 about an axis extending through the third side 14*c* and the fourth side of the seat 14) and/or the second direction 62 (e.g., a top of the seat 14 may be rotated toward the second direction 60 about an axis extending through the third side 14*c* and the fourth side of the seat 14) to position the plane A-A of the seat 14 in a non-parallel orientation with respect to the plane B-B of the frame or support 12 and form an angle Q between the plane A-A and the plane B-B, as shown in FIGS. 8 and 9. To adjust the seat 14 such that the plane A-A of the seat 14 is in a non-parallel position with respect to the plane B-B of the frame or support 12, the seat 14 may be rotated or tilted toward the first direction and/or the second direction. Illustratively, the seat 14 may be rotated or tilted toward a direction when a side of the seat 14 from which a direction starts (e.g., the first direction 60 starts from the side 10*a* and travels toward the side 10*b*) is adjusted up and away from the frame or support 12. Further, the seat 14 may be adjusted, such that the seat 14 is rotated toward the third direction 64 and/or the fourth direction 66. The third direction 64 and/or the fourth direction 66 ma be substantially perpendicular to the first direction 60 and/or the second direction 62.

Figure 10:
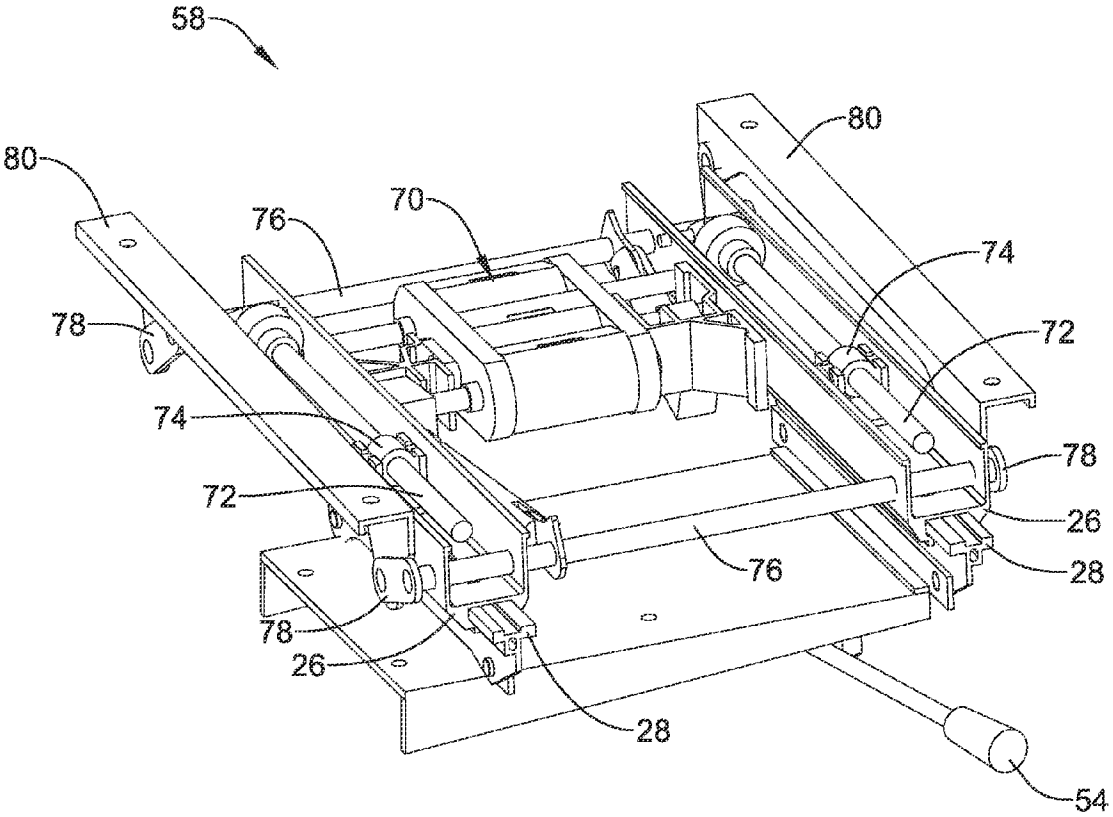
FIG. 10 is a schematic perspective view from above an illustrative seat adjustment mechanism of an illustrative powered wheelchair structure.

Illustratively, a first track 26 may engage a second track 28 of an adjustment mechanism 58, as shown in FIG. 10, to facilitate lateral (e.g., side-to-side) and/or angled adjustment of the seat 14. Illustratively, the first track 26 may be connected to the seat 14 or may otherwise extend from the seat 14 and the second track 28 may be connected to the frame or support 12 or may otherwise extend from the frame or support 12. In some instances, the first track 26 may slide in the first direction 60 and/or the second 62 direction along the second track 28 to adjust the position of the plane A-A of the seat 14 with respect to the plane B-B of the frame or support 12.

The adjustment mechanism 58 may be directly connected to the seat 14 and/or the support 12. Alternatively, or in addition, the adjustment mechanism 58 may be indirectly connected to one or more of the seat 14 and/or the frame or support 12 through one or more extensions 56 or other features. In some instances, a lever 54 may be utilized to facilitate connecting and/or releasing the adjustment mechanism 58 from the extension 56.

The seat 14 may be adjusted with respect to the frame or support 12 in any manner. For example, the position and/or orientation of the seat 14 may be manually adjusted and/or may be adjusted by a motor or other powered adjustment actuator that may be controllable via the joystick controller 46 or other controller. In one example, a motor 70 may be in communication with the seat 14 to position the plane A-A of the seat 14 in a position offset from and parallel to the plane B-B of the frame or support 12 (e.g., to laterally adjust the seat 14 in the first direction 60 and/or the second direction 62) and/or to position the plane A-A of the seat 14 in a non-parallel orientation with respect to the plane B-B of the frame or support 12 (e.g., to rotate the seat 14 toward the first direction 60 and/or the second direction 62). Additionally, or alternatively, the motor 70 may be actuated to adjust the seat in any other direction and/or in any other manner.

In some instances, as shown in FIG. 10, the motor 70 and/or connections thereto may be capable of effecting rotation of one or more threaded rods 72 and/or one or more female threaded members 74 (e.g., a nut or other female threaded member). Illustratively, threads of the threaded rod 72 or threads of the female threaded member 74 may be configured to engage threads of one or more threaded female pieces 74 or threads of one or more threaded rods 72, respectively, fixed with respect to the seat and/or the first track 26. As a result of the configuration shown in FIG. 10, when the threads of the threaded rods 72 engage the threads of the female threaded members 74 and the motor 70 is actuate to rotate the threaded rods 72, the rotation of rods 72 within the female threaded members 74 may laterally adjust the seat 14 with respect to the frame or support 12.

In some instances, as shown in FIG. 10, the motor 70 and/or connections thereto may be capable of effecting rotation of one or more pivot rods 76. The pivot rods 76 may be affixed to, or fixed with respect to, a bridge bar 78 extending radially therefrom, where the bridge bar 78 may be pivotally connected to one or more seat supports 80 connected to the seat 14. As a result of the configuration shown in FIG. 10, when the motor 70 is actuated to rotate the pivot rods 76, the bridge bars 78 are rotationally adjusted to raise and/or lower the seat supports 80, which may allow for rotational adjustment of the seat 14. In some cases, a first side 14*a* of the seat 14 may be raised and the seat 14 rotated toward the first direction 60, a second side 14*b* of the seat 14 may be raised and the seat 14 rotated toward the second direction 62, and/or a first side 14*a* of the seat 14 may be raised and a second side of the seat 14 may be raised to effectively adjust a height of the seat 14. Illustratively, the seat 14 may have a third side 14*c* and a fourth side 14*d*, where the first and second sides 14*a*, 14*b* of the seat may be opposite sides and may be substantially perpendicular to the third and fourth sides 14*c*, 14*d* of the seat 14.

Figure 11:
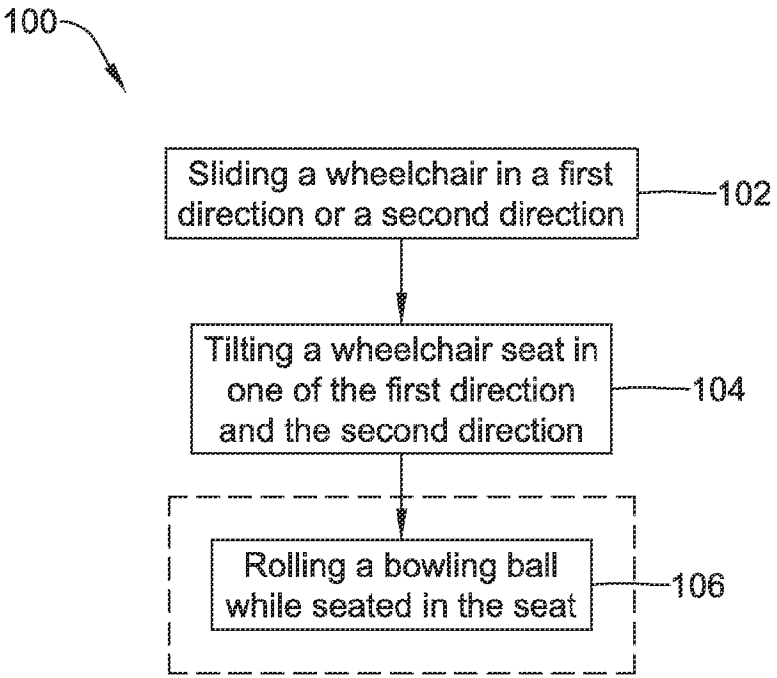
FIG. 11 is a schematic flow diagram of an illustrative method of a powered wheelchair.

In operation, the wheelchair 10 or other wheelchair may be adjusted with a method 100, as shown in FIG. 11, among other methods. The wheelchair 10 including the seat 14 supported by the frame or support 12 may be utilized in the method 100, where the method 100 includes sliding 102 the seat 14 in one of the first direction 60 and the second direction 62. Further, the method 100 may include rotating 104 the seat 14 toward the one of the first direction 60 and the second direction 62. As discussed above, the first direction 60 and the second direction 62 may be substantially perpendicular to a third direction 64, where the second portion 32 (e.g., the back portion) of the seat faces the third direction 64. In some instances, when the seat is laterally sliding 102, the first track 26 (e.g., the track of the seat 14) may slide along the second track 28 (e.g., the track of the frame or support 12). One may manually laterally slide 102 the seat 14 or manually rotate 104 the seat 14, or one may utilize the motor 70 to laterally slide 102 or rotate 104 the seat 14. In one example, the method 100 may include actuating the motor 70 to laterally slide the seat 14 in one of the first direction 60 and the second direction 62 and rotate the seat 14 toward the one of the first direction 60 and the second direction 62 in which the seat 14 has been laterally slid. Alternatively, or in addition, the motor 70 may be actuated to rotate the seat toward one of the first direction 60 and the second direction 62 opposite the direction in which the seat 14 has been laterally slid. In some instances, the rotating 104 of the seat 14 may be performed before laterally sliding 102 the seat 14.

In some instances, the seat 14 of the wheelchair 10 may be adjusted to facilitate rolling a bowling ball while bowling or to facilitate participating in any other sport or activity (e.g., fencing, trimming a garden, tossing a ball underhand, dribbling a basketball, swinging a racquet or club, participating in a track and field event, etc.). In one example, the method 100 may include a user rolling 106 a bowling ball while seated in the seat 14, wherein the seat 14 may be laterally slid and rotated with respect to the frame or support 12 that supports the seat 14 to roll the bowling ball from an off-centered and titled position (e.g., where the seat 14 is slid and rotated toward the direction of a user's arm that will be utilized to roll the bowling ball). Additionally, or alternatively, the adjustability of the seat 14 of the wheelchair 10 may allow or facilitate a user seated in the seat 14 to perform acts which may otherwise be restricted by the user's position in the seat 14.

The configuration of the wheelchair 10 may take on numerous other embodiments while staying within the spirit of this disclosure. For example, the wheelchair 10 may have any number of wheels 16 (e.g., three wheels 16 with one wheel 16 in back or in front and two wheels 16 in the other of the back or front), one or more accessories, and/or any design specification, as desired. Illustratively, one or more optional accessories may be used with the wheelchair 10 in addition to or as an alternative to the accessories discussed herein, some of which may be shown in FIG. 1. For example, the wheelchair 10 may include one or more footrests, one or more joystick controllers 46 or other controller(s) to maneuver a motorized wheelchair 10 and/or parts thereof (including parts of a manual wheelchair), one or more removable or non-removable ball racks to support bowling balls, one or more trays, one or more handles, and/or other similar or dissimilar accessories that facilitate comfort and functionality while using the wheelchair 10, as desired. In some instances, the accessories and/or other features of the wheelchair 10 may be connected to one another in any manner. For example, the accessories and/or other features may connect to one another through a weld connection, a threaded connection, a ball-detent connection, a hook and loop connection, a pressure-fit connection, a slide connection, a bayonet connection, or through any other separable or non-separable connection mechanism.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A wheelchair assembly, comprising:

a seat, wherein a first plane extends through the seat;

a frame in communication with the seat, wherein a second plane extends through the frame and is in line with the first plane when the seat is in a first position;

a plurality of wheels supporting the frame;

wherein the seat is laterally adjustable in one or more of a first direction and a second direction along a track to position the first plane in a second position offset from and parallel to the second plane, where the seat maintains a substantially constant height above a flat surface on which the plurality of wheels rest.

2. The wheelchair assembly of claim 1, wherein the track comprises:

a track of the seat; and a track of the frame; and wherein the track of the seat slides in the first direction or the second direction along the track of the frame to adjust the position of the first plane with respect to the second plane.

3. The wheelchair assembly of claim 1, wherein the seat is slidingly adjustable in one or more of the first direction and the second direction to position the first plane in a non-parallel orientation with respect to the second plane.

4. The wheelchair assembly of claim 1, wherein the seat is rotatable toward one or more of the first direction and the second direction to position the first plane in a non-parallel orientation with respect to the second plane.

5. The wheelchair assembly of claim 1, wherein the seat is rotatable toward a third direction, where the third direction is substantially perpendicular to the first direction and the second direction.

6. The wheelchair assembly of claim 1, further comprising:

a motor in communication with the seat to position the first plane in one or more of the position offset from and parallel to the second plane and a non-parallel orientation with respect to the second plane.

7. The wheelchair assembly of claim 1, wherein the seat is adjustable in a third direction and a fourth direction while maintaining the first plane substantially in-line with the second plane.

8. The wheelchair assembly of claim 1, wherein the seat is adjustable in a third direction and a fourth direction, wherein the third direction and the fourth direction are substantially perpendicular to the first direction and the second direction.

9. The wheelchair assembly of claim 1, wherein the seat is an automobile seat.

10. The wheelchair assembly of claim 1, wherein:

the seat has a base portion having a depth of a first distance;

the seat has a back portion having a height of a second distance; and the second distance is greater than the first distance.

11. The wheelchair assembly of claim 1, wherein the seat is rotatable toward one or more of the first direction and the second direction about a horizontal axis extending in a direction in which the first plane and the second plane extend.

12. A wheelchair assembly, comprising:

a seat having a base portion and a back portion facing a first direction;

one or more wheels; and a support supporting the seat and the one or more wheels with respect to the seat; and wherein:

the seat is laterally adjustable in a second direction and a third direction along a single plane, the second and third directions are substantially perpendicular to the first direction; and the seat is rotatable toward the second direction and the third direction with respect to the support.

13. The wheelchair assembly of claim 12, further comprising:

a motor in communication with the seat to laterally adjust the seat in one or more of the second direction and the third direction.

14. The wheelchair assembly of claim 13, wherein the motor operates to rotate the seat toward one or more of the second direction and the third direction with respect to the support.

15. The wheelchair assembly of claim 12, wherein:

the base portion has a depth of a first distance;

the back portion has a height of a second distance; and the second distance is greater than the first distance.

16. A method of using a wheelchair, the method comprising:

providing an adjustable wheelchair having a seat and a support supporting the seat;

laterally adjusting the seat of the wheelchair in one of a first direction and a second direction along a single plane; and laterally rotating the seat of the wheelchair toward the one of the first direction and the second direction.

17. The method of claim 16, further comprising:

performing a sports activity while positioned in the wheelchair.

18. The method of claim 16, further comprising:

actuating a motor to laterally adjust the seat of the wheelchair in one of the first direction and the second direction.

19. The method of claim 16, further comprising:

actuating a motor to laterally rotate the seat of the wheelchair toward the one of the first direction and the second direction.

20. The method of claim 16, further comprising:

rolling a bowling ball while seated in the seat; and wherein the seat of the wheelchair is laterally adjusted and rotated with respect to a support that supports the seat to roll the bowling ball from an off-centered and titled position.

* * * * *

UNITED STATES PATENT AND TRADEMARK OFFICE

CERTIFICATE OF CORRECTION

PATENT NO. : 8,684,398 B1
APPLICATION NO. : 13/920528
DATED : April 1, 2014
INVENTOR(S) : Michael Nyitray It is certified that error appears in the above-identified patent and that said Letters Patent is hereby corrected as shown below:

In the Specification

Column 3
Line 36: delete “srange”, and insert therefor --substantially full range--.

Column 7
Line 66: delete “ma”, and insert therefor --may--.

Signed and Sealed this
Eighth Day of July, 2014

Michelle K. Lee

Michelle K. Lee
*Deputy Director of the United States Patent and Trademark Office*